United States Patent [19]

Phillips et al.

[11] Patent Number: 5,002,125

[45] Date of Patent: Mar. 26, 1991

[54] FRACTURING PROCESS USING A VISCOSITY STABILIZED ENERGIZING PHASE

[75] Inventors: Alice M. Phillips, Fort Worth, Tex.; David J. Mack, Edmond, Okla.

[73] Assignee: The Western Company of North America, Fort Worth, Tex.

[21] Appl. No.: 388,671

[22] Filed: Aug. 2, 1989

[51] Int. Cl.[5] ..... E21B 43/26

[52] U.S. Cl. ..... 166/271; 166/273; 166/280; 166/308; 166/309; 252/8.551

[58] Field of Search ..... 252/8.551; 166/271, 166/273, 280, 308, 309

[56] References Cited

U.S. PATENT DOCUMENTS

| | | | |
|---|---|---|---|
| Re. 32,302 | 12/1986 | Almond et al. . | |
| 3,195,634 | 7/1965 | Hill . | |
| 3,310,112 | 3/1967 | Nielsen et al. . | |
| 3,396,107 | 8/1962 | Hill . | |
| 3,898,165 | 8/1975 | Ely et al. . | |
| 3,918,524 | 11/1975 | Broaddus et al. . | |
| 3,948,325 | 4/1976 | Winston et al. . | |
| 3,954,142 | 5/1976 | Broaddus et al. . | |
| 4,212,354 | 7/1980 | Guin . | |
| 4,233,166 | 11/1980 | Allen . | |
| 4,313,834 | 2/1982 | Harris . | |
| 4,324,668 | 4/1982 | Harris . | |
| 4,436,156 | 3/1984 | Fredrickson . | |
| 4,440,653 | 4/1984 | Briscoe et al. . | |
| 4,460,627 | 7/1984 | Weaver et al. . | |
| 4,463,810 | 8/1984 | Hill | 166/308 |
| 4,477,360 | 10/1984 | Almond . | |
| 4,480,696 | 11/1984 | Almond et al. . | |
| 4,487,866 | 12/1984 | Almond et al. . | |
| 4,487,867 | 12/1984 | Almond et al. . | |
| 4,519,455 | 5/1985 | Holtmyer et al. . | |
| 4,524,829 | 6/1985 | Hanlon et al. . | |
| 4,532,052 | 7/1985 | Weaver et al. . | |
| 4,541,935 | 9/1985 | Constien et al. | 166/308 |
| 4,552,215 | 11/1985 | Almond et al. . | |
| 4,553,601 | 11/1985 | Almond et al. . | |
| 4,554,082 | 11/1985 | Holtmyer et al. . | |
| 4,606,772 | 8/1986 | Almond et al. . | |
| 4,622,155 | 11/1986 | Harris et al. . | |
| 4,627,495 | 12/1986 | Harris et al. . | |
| 4,701,270 | 10/1987 | Bullen et al. | 252/8.551 |

*Primary Examiner*—Ramon S. Britts
*Assistant Examiner*—Roger J. Schoeppel
*Attorney, Agent, or Firm*—Richards, Medlock & Andrews

[57] ABSTRACT

Hydraulic fracturing process in which a normally gaseous energizing phase is incorporated into an aqueous fracturing fluid in a manner to effect good dissemination and stabilization of the energizing phase in the fracturing liquid. A normally gaseous energizing phase is incorporated into an aqueous fracturing fluid having a viscosity at wellhead conditions within the range of 10-300 centipoises. The fracturing fluid containing the energizing phase is introduced into the well and displaced from the wellhead down the well to the vicinity of the subterranean formation. During the displacement of the fracturing fluid from the wellhead to the vicinity of the formation, the viscosity of the fracturing fluid is increased by a factor about 2 or more. The higher viscosity fracturing fluid is displaced from the well into the formation in the course of the fracturing process. The energizing phase is provided by incorporating a substantial amount of liquid carbon dioxide into the aqueous fracturing fluid. Nitrogen gas may also be incorporated into the fracturing fluid. Mixing of a cross-linking agent within the fracturing fluid and cross-linking of a polymeric thickening agent causes viscosity enhancement of the fracturing fluid as it moves down the wellbore.

26 Claims, 1 Drawing Sheet

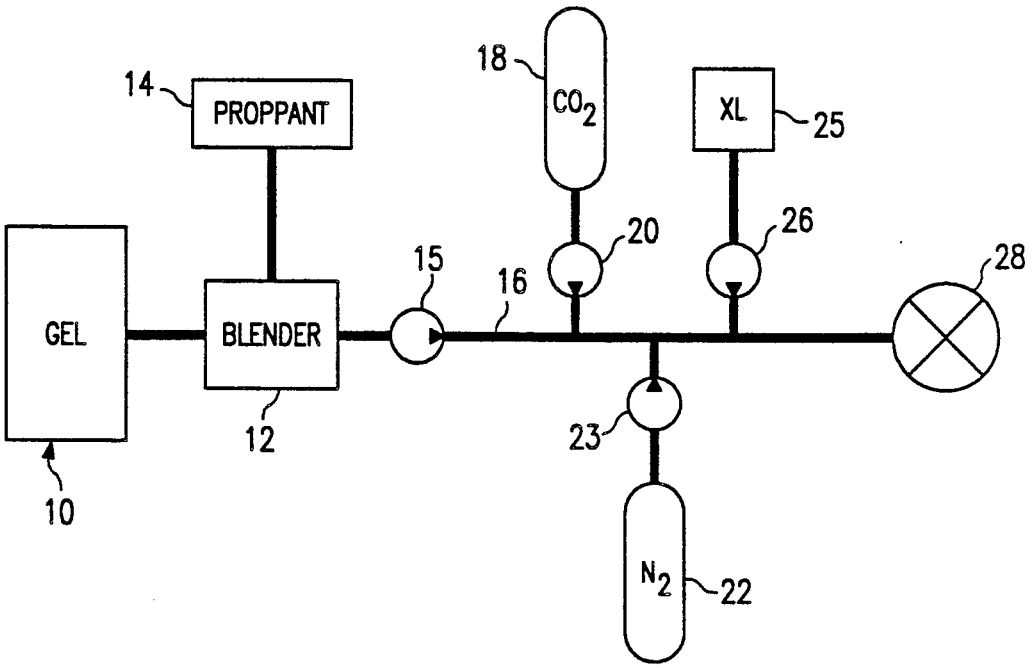
14
PROPPANT
18
$CO_2$
XL
25
20
26
28
15
16
GEL
BLENDER
12
23
10
$N_2$
22

FRACTURING PROCESS USING A VISCOSITY STABILIZED ENERGIZING PHASE

FIELD OF THE INVENTION

This invention relates to the formation of fractures in subterranean earth formations and more particularly to hydraulic fracturing in which an energizing phase is incorporated into a fracturing fluid and stabilized by viscosity enhancement after incorporation.

BACKGROUND OF THE INVENTION

It is a common practice to treat subterranean formations to increase the gross permeability or conductivity of such formations by procedures which are identified generally as fracturing processes. For example, it is a conventional practice to hydraulically fracture a well in order to produce one or more cracks or "fractures" in the surrounding formation by a mechanical breakdown of the formation. Fracturing may be carried out in wells which are completed in subterranean formations for virtually any purpose. The usual candidates for fracturing, or other stimulation procedures, are production wells completed in oil and/or gas containing formations. However, injection wells used in secondary or tertiary recovery operations, for example, for the injection of water or gas, may also be fractured in order to facilitate the injection of fluids in such subterranean formations.

Hydraulic fracturing is accomplished by injecting a hydraulic fracturing fluid into the well and imposing sufficient pressure on the fracturing fluid to cause the formation to breakdown with the attendant production of one or more fractures. The fracture or fractures formed may be horizontal or vertical, with the latter usually predominating, and with the tendency toward vertical fracture orientation increasing with the depth of the formation being fractured. Simultaneously with or subsequent to the formation of the fracture, a thickened carrier fluid having a propping agent such as sand or other particulate material suspended therein is introduced into the fracture. The propping agent is deposited in the fracture and functions to hold the fracture open after the pressure is released and the fracturing fluid withdrawn back into the well. The fracturing fluid usually contains a thickening agent in order to impart a sufficiently high viscosity to retain the propping agent in suspension or at least to reduce the tendency of the propping agent to settle out of the fluid.

Another common procedure for increasing the gross or apparent permeability of subterranean formations is acidizing. In this procedure, an aqueous solution of a suitable acid is injected into the well undergoing treatment under sufficient pressure to force it into the surrounding formation where it dissolves acid-soluble material in the formation to form small fissures or fractures. Carbonate-containing formations usually are treated with acidizing procedures and suitable acids for use in this regard are hydrochloric, formic and acetic acids. In some cases, however, sandstones containing little or no carbonate materials may be treated with acids such as hydrochloric or hydrofluoric acid or blends thereof.

Acidizing and hydraulic fracturing may also be employed in a common procedure. An acidizing fluid may be injected into the well under sufficient pressure to cause the formation to break down to produce fractures by hydraulic fracturing. This may be followed by a conventional nonacidic hydraulic fracturing fluid containing a propping agent or the acidizing fluid may itself contain a propping agent.

A number of additives may be employed in the course of a typical fracturing process. Thickening agents and propping agents are discussed above. In many cases, the initial portion of the fracturing fluid, referred to sometimes as a "pad" or "spearhead" will be free of propping agent and will be of a relatively low viscosity. Propping agent and thickening agent may be added to the portion of the fracturing fluid following the "spearhead". It is also conventional to employ a fluid loss additive in all or part of the fracturing fluid. In the case of hydraulic fracturing, the fluid loss agent minimizes the loss of fracturing fluid to the formation as the formation breakdown pressure is reached, thus aiding in the initiation of the fracture. In addition, once the fracture is formed, fracture propagation is enhanced by decreasing filtrate loss through the walls of the fracture into the formation matrix. It is also known in the art to incorporate a surfactant into at least a portion of the fracturing fluid to facilitate clean-up of the fracturing fluid at the conclusion of the stimulation operation. The surfactant functions to reduce the water-rock and oil-water interfacial tensions so that when the well is placed on production, the oil effectively displaces the water-based treating fluid from the formation matrix back into the well.

Other materials which may be incorporated with the more conventional fracturing liquids include normally gaseous materials which function to form a gas phase at the wellhead, or at the formation being fractured, or both. One such process disclosed in U.S. Pat. No. 3,310,112 to Nielsen et al. involves the use of substantial quantities of liquid carbon dioxide in conjunction with a carrier liquid such as gelled water containing particulate propping agent. Very large quantities of carbon dioxide are employed in the Nielsen procedure to provide a ratio of at least 5 and preferably at least 7 volume units of carbon dioxide per volume of slurry of propping agent. The liquid carbon dioxide is converted in the formation to gas, due to pressure reduction when the well pressure is released and the fact that the formation usually will be above the critical temperature of carbon dioxide. Upon releasing the pressure, a substantial portion of the gelled liquid is carried back out of the well by the gaseous carbon dioxide.

U.S. Pat. No. 3,937,283 to Blauer discloses a hydraulic fracturing process employing a foam formed of a gas such as nitrogen, carbon dioxide, air or hydrocarbon gases and a liquid such as water or an oil based liquid. The foam is characterized as having a Mitchell quality within the range of 0.5236–0.9999 and preferably between the range of 0.60–0.85.

U.S. Pat. No. 4,480,696 (Re 32,302) to Almond et al. discloses a water-carbon dioxide fracturing fluid characterized as an emulsion of liquified carbon dioxide and water at surface conditions which is converted into a gas and liquid foam upon heating in the formation to a temperature above the critical temperature of the carbon dioxide. The fracturing fluid contains a surfactant to stabilize the emulsion and the resulting foam and also gelling agents as well as propping agents. The volumetric ratio of liquid carbon dioxide to aqueous fluid is described as being in the range of 1:1 to about 20:1, preferably about 2:1 to 18:1, and the foam having a quality of about 50% to an excess of about 96%.

A gelling agent such as a natural or synthetic hydratable polymer may be mixed with the aqueous liquid prior to formation of the emulsion. An inhibitor which functions to retard the hydration rate and therefore delay a viscosity increase in the solution may be employed. Compounds containing multivalent metals which release metal ions in aqueous solution to function as cross-linking or complexing agents for the hydratable polymer may be employed as inhibitors. A propping agent is added to the gelled aqueous liquid followed by admixing with the liquid carbon dioxide. As the fracturing fluid is introduced into the subterranean formation, the fluid is heated to above the critical temperature of carbon dioxide to produce a foam which maintains the viscosity of the fracturing fluid. After fracturing of the formation, the well is shut in for a stabilization period and then opened under controlled conditions to provide a pressure drop which causes the foam to break. The carbon dioxide gas functions to produce liquids from the fracturing area to leave the formation clean and ready for the commencement of production.

U.S. Pat. No. 4,488,975 to Almond discloses a hydraulic fracturing process in which carbon dioxide is employed to reduce the pH of an aqueous fracturing fluid to a level below about 5.5 and preferably below about 4 in order to controllably activate a cross-linking agent. As disclosed in Almond, a thickening agent including various natural or synthetic hydratable polymers is added to the aqueous fluid in an amount of about 20–60 lbs. per one thousand gallons of aqueous fluid. Also added is a cross-linking agent, preferably zirconium acetylacetonate chelate or aluminum acetate chelate, which does not cause cross-linking of the polymer to any significant extent until the pH is reduced to about 5.5. Sufficient carbon dioxide is added to reduce the pH to a level below about 5.5, preferably below about 4.0. The carbon dioxide can be added in an amount of up to 95% by volume of the fracturing fluid. The propping agent in Almond preferably is added to the fracturing fluid after addition of the carbon dioxide and cross-linking agent. In addition to providing for pH control, the carbon dioxide can also function to provide for significant clean-out at the conclusion of the fracturing job if the carbon dioxide is present in an amount greater than about 15% by volume of the fluid.

SUMMARY OF THE INVENTION

In accordance with the present invention, there is provided a hydraulic fracturing process in which a normally gaseous energizing phase is incorporated into an aqueous based fracturing fluid in a manner to effect good dissemination of the energizing phase throughout the fracturing liquid and the system thereafter stabilized for injection down the well and into the formation. In carrying out the invention, there is provided an aqueous fracturing fluid having a viscosity at wellhead conditions within the range of 10–300 centipoises, and preferably within the range of 10–100 centipoises, at a shear rate of 170 $sec^{-1}$. A normally gaseous energizing phase is incorporated into the fracturing fluid, and the fracturing fluid containing the energizing phase is introduced into the well and displaced from the wellhead down the well to the vicinity of the subterranean formation. During the displacement of the fracturing fluid in the wellhead to the vicinity of the formation, the viscosity of the fracturing fluid is increased by a factor of about 2 or more. The higher viscosity fracturing fluid is displaced from the well into the formation in the course of the fracturing process.

In a further aspect of the invention, the energizing phase is provided by incorporating a substantial amount of liquid carbon dioxide into the aqueous fracturing fluid. The fracturing fluid contains a cross-linkable polymeric thickening agent in a hydrated state providing an increased viscosity of the fracturing fluid. Preferably, the fracturing fluid as it is introduced into the wellhead comprises at least ⅓ by volume liquid carbon dioxide. Substantially greater amounts of liquid carbon dioxide may be employed, particularly where a gaseous phase such as provided by nitrogen is not also employed A cross-linking agent is added to the fracturing fluid. Turbulent flow conditions are produced in the surface lines to the wellhead and the well tubulars attendant to the introduction of the fracturing fluid into the well and down the well to the formation to cause mixing of the cross-linking agent within the fracturing fluid and viscosity enhancement of the fracturing fluid as it moves down the wellbore.

BRIEF DESCRIPTION OF THE DRAWING

The drawing is a schematic representation of a surface mixing facility which may be used in the invention.

DETAILED DESCRIPTION

As noted previously, both nitrogen and carbon dioxide have been incorporated into hydraulic fracturing fluids in order to provide a downhole gaseous phase while at the same time functioning as a portion of the fracturing fluid in which the propping agent is suspended as the fluid is pumped down the well and into the formation The present invention employs a gaseous energizing phase which can be nitrogen or carbon dioxide or a mixture of carbon dioxide and nitrogen which is incorporated into the aqueous fracturing liquid in a manner in which good distribution of the energizing phase is attained while at the same time providing for stability of the energizing phase-fracturing fluid system through viscosity enhancement. By the term "gaseous energizing phase" is meant a material which is normally gaseous, and, while it may be and preferably includes liquid at wellhead conditions, is in a gaseous state at the conclusion of the fracturing process. Preferably, the energizing phase comprises carbon dioxide which initially is in the liquid state. The invention may also be carried out with the addition of both carbon dioxide and nitrogen, which is in the gas phase at the wellhead conditions as well as at the formation conditions of temperature and pressure. By the term "aqueous fluid" as used herein, is meant an aqueous medium formed of water or one or more water miscible liquids which may be incorporated into the fracturing fluid. For example, water miscible low molecular weight aliphatic alcohols such as methanol, ethanol, isopropyl alcohol or tertiary butyl alcohol may be incorporated into the aqueous based fracturing fluid in order to prevent hydration of clays in relatively dry formations such as natural gas reservoirs. Such alcohols provide fundamentally aqueous based fluids in the sense of the incorporation and hydration of polymeric thickening agents, the inclusion of cross-linking agents fluid loss control agents and the like, as well as the inclusion of the carbon dioxide and nitrogen, but they do not cause the hydration and swelling of formation clays. The alcohols also function as good clean-up agents in effectively displacing hydrocarbon fluids. Usually, alcohol, principally methanol or isopropyl alcohol, is used as a minor component of the aqueous liquid. Substantially, pure alcohol can be used but this would be a rare occurrence because of cost and safety conditions due to the flammability of alcohols such as methanol.

As described above, in the fracturing process disclosed in the aforementioned Patent No. 4,480,696 to Almond et al, stability of an initially injected liquid carbon dioxide-aqueous liquid emulsion and of a foam ultimately formed under downhole conditions is accomplished by providing a selected surfactant in an admixture of the aqueous liquid and gelling agent with liquid carbon dioxide. In the Almond et al. process, the viscosity of the foam immediately after formation is described as being substantially the same as the viscosity of the liquid carbon dioxide-fracturing fluid emulsion. Hydration of the polymeric thickening agents used in Almond et al is inhibited or retarded in order to delay a viscosity increase through the use of inhibitors which function to cross-link, form a complex, or otherwise tie up the functional groups of the polymer so that the rate of hydration of the polymer is retarded. The inhibition of the polymers to undergo hydration can be reversed by a change in pH of the solution or by heating the solution to a temperature in excess of about 140° F.

In contrast to the procedure disclosed in Almond et al., a stable energizing phase-fracturing fluid system is provided in accordance with the present invention and without the need for a stabilizing surfactant through the use of a polymeric thickening agent. The thickening agent functions to provide an increased viscosity of the aqueous fracturing fluid at the time of incorporation of the energizing phase and thereafter undergoes further viscosity enhancement in order to stabilize the dispersion of energizing phase within the liquid. Here, cross-linking agents are used to increase the viscosity of the initially formed aqueous solution from a first elevated value after the polymeric thickening agent has reached an initial state of hydration in the fracturing fluid to yet a higher stabilizing value. During displacement of the fracturing fluid down the well, the viscosity of the fracturing fluid is increased by a factor of at least 2 to a value sufficient to stabilize the energizing phase in the aqueous fracturing fluid phase without the inclusion of a foam stabilizing, surfactant in the aqueous phase. Thickening agent and cross-linking agent systems useful in the present invention include those in which activity is enhanced at low ph as well as those in which activity is retarded at low pH values. The incorporation of liquid carbon dioxide into the fracturing fluid in accordance with the present invention thus can increase the activity of the cross-linking agent through a reduction in solution pH as disclosed in the aforementioned patent 4,488,975 to Almond, although preferably the low pH acts to delay cross-linking. However, whereas in Almond no steps are taken to liquify the carbon dioxide added to the fracturing fluid, here stability of a liquid dispersion of liquid carbon dioxide in the fracturing fluid is enhanced by the relatively stiff "gel" formed as the polymeric thickening agent is cross-linked in the presence of the liquid carbon dioxide. Also, whereas the Almond 975 patent states that it is preferred to add the cross-linking agent early in the surface procedure, before propping agent addition, in the present invention, the cross-linking agent preferably is added sufficiently near the wellhead so that cross-linking takes place as the fracturing fluid is pumped down the well.

The process of employing liquid carbon dioxide and stabilizing the liquid carbon dioxide water system in accordance with the present invention, may be illustrated by reference to a typical hydraulic fracturing operation. In most hydraulic fracturing, the initial fracturing fluid injected into the well usually will be free of a propping agent and may be of a somewhat lower viscosity than the fluid subsequently injected. As the initial fracturing fluid is pumped into the well and reaches the zone of the well adjacent to the formation to be fractured, a high pressure is established at the face of the formation due to the fact that the fluid loss from the well into the formation is less than the rate at which the fluid is being introduced into the well. As the pumping operation continues, the pressure at the face of the formation ultimately reaches the so-called "formation breakdown pressure" at which time the formation is mechanically ruptured and one or more fractures are formed. The initiation of a fracture in the formation usually is accompanied by a relatively abrupt and substantial decrease in pressure which is sensed at the wellhead. Thereafter, the pressure at the wellhead remains fairly constant as the fracture is extended deeper into the formation by the continued injection of fracturing fluid into the well.

In some hydraulic fracturing procedures, the initial fracturing fluid is an aqueous solution of an acid, typically a mineral acid such as hydrochloric acid. In other cases a neutral fluid such as water or 2 weight percent sodium or potassium chloride solution may be employed. In either case, the initial fluid will usually be free of propping agent and may be of a relatively low viscosity in order to provide good initial penetration into the formation. The fracturing fluid injected subsequent to the initial "spearhead" or "pad" fluid will be provided with a propping agent such as "frac sand" and treated with a thickening agent in order to provide a viscosity capable of retaining the propping agent in suspension as it is pumped down the well and into the fracture. A typical propping agent is 12–20 or 20–40 mesh Ottawa frac sand which may be employed in concentrations ranging from about 0.5–20 pounds of sand per gallon of fracturing fluid. Another propping agent takes the form of sintered ceramic particles with the aforementioned size range. Thickening which may be employed to increase the viscosity of the aqueous solutions include natural or synthetic polymeric materials such as natural gums and synthetic polyelectrolytes as described in greater detail below. This portion of the fracturing fluid may be thickened to provide any desired viscosity, normally within the range of about 10–100 centipoises at a shear rate of about 170 $sec^{-}$. However, as noted previously, substantially greater amounts of thickening agent may be employed to increase the viscosity up to a value of about 300 centipoises at 170 $sec^{-1}$. Unless otherwise indicted, viscosity values are presented herein at 170 sec-1. The propping agent concentration may be progressively increased during this stage of the operation.

Subsequent to the injection of the propping agent into the fracture, it is desirable to complete the operation with the injection of a flushing fluid which is free of propping agent or in which the propping agent is progressively decreased. This flushing fluid functions to displace previously injected propping agent into the fracture and reduces the accumulation of undesirable quantities of propping agent within the well proper. At the conclusion of the fracturing operation, the well is swabbed or otherwise placed on production in order to reverse the pressure gradient established adjacent to the well and produce the injected fluids back into the wellbore.

A gaseous energizing phase may, in accordance with the present invention, be added to the aqueous fracturing fluid at one or more of the above stages of operation. For example, the liquid used during the earliest stage of the operation may be an aqueous hydrochloric acid solution, brine or plain water having a viscosity of about one centipoise, i.e., containing no polymeric thickening agent, or having a higher viscosity by virtue of the addition of a thickening agent. Where a thickening agent is present, the gaseous energizing phase may be added to the fracturing fluid and the thickening agent then cross-linked to enhance stability. A propping agent normally wil not be present here but liquid carbon dioxide may be incorporated into the propping-agent free liquid used at this stage of the operation and the system stabilized as described above.

At the conclusion of this "spearhead" or "pad", the aqueous based fracturing fluid containing the energizing phase, preferably liquid carbon dioxide, and also containing propping agent is injected down the well. The viscosity of the fluid at this stage of operation will normally be greater than that the spearhead fluid, either by virtue of the addition of thickening agent or, if the polymer concentration is the same here as in the preceding stage, the addition of propping agent will normally result in a substantially increased viscosity. After injection of propping-agent containing fluid, the fracturing operation normally is concluded by the injection of a flushing fluid to displace the propping agent into the fracture. The flushing fluid also preferably contains liquid carbon dioxide and preferably both the propping agent fluid and the flushing fluid are stabilized by cross-linking. However, in some cases cross-linking of the flushing fluid may not be required. At the conclusion of the flushing or displacing fluid injection step, as the final step of the process, the well is shut in to allow the injected fluids to reach or approach an equilibrium state in which, in the normal course of events, the carbon dioxide will be in the gaseous phase. The shut-in period before placing the well on production may vary from periods of less than one hour to periods of perhaps 3–6 hours depending upon the formation and operating conditions. For example, in the unlikely event, the formation is near or only marginally above the critical temperature of carbon dioxide, the shut-in period will probably be longer than for those cases in which the formation temperature is well above the critical temperature of carbon dioxide. In either case, when the well is placed on production by reducing the well pressure and providing for a positive pressure gradient extending from the formation into the well, the gaseous carbon dioxide functions to effectively displace the aqueous fracturing fluid from the formation into the wellbore.

The present invention may be carried out by the addition of both nitrogen and carbon dioxide with the incorporation of substantial quantities of both materials into the fracturing fluid. As will be recognized by those skilled in the art, carbon dioxide is highly soluble in water and in the liquid phase can be incorporated into the water in substantial quantities to provide a solution or dispersion with the water. Nitrogen, however, is relatively insoluble ranging usually from less than about 0.3 wt. % at wellhead conditions to even lower solution concentrations at the substantially higher temperatures normally encountered at the bottom of a well. Notwithstanding the dissimilar characteristics of nitrogen and carbon dioxide, these two gases can be used together in the present invention, and moreover, the nitrogen can be used in a substantial amount, normally resulting in a decrease in carbon dioxide from the normal amount. This aspect of the invention provides for effective "clean up" of the well at the conclusion of the fracturing process and reduces scale formation which is attendant to the presence of large quantities of carbon dioxide. Moreover, the relatively high amount of nitrogen in conjunction with the carbon dioxide and water functions as an effective carrier liquid for propping agent. The nitrogen is inert in the liquid phase and by reducing the carbon dioxide content, stability of the thickened aqueous phase is enhanced. While the invention is not to be limited by theory, it is believed that by using a relatively high nitrogen content, and correspondingly less carbon dioxide, acid hydrolysis of the polymeric thickening agent is minimized, thus enhancing the life of the thickened aqueous phase, resulting in better and longer suspension of the propping agent, and in better foam stability.

The nitrogen, because of its low solubility in water, or in hydrocarbon fluids which may be present in the formation, exists almost exclusively as a separate gas phase and thus provides an immediate driving force for rapid and effective expulsion of the fracturing fluids from the formation into the well when the pressure gradient is reversed This, together with the reduced tendency to scaling occasioned by the presence of carbon dioxide, provides for good clean-up characteristics at the conclusion of the fracturing operation. The use of both nitrogen and carbon dioxide provides for a two-stage clean-up process in which the nitrogen gas initially acts to dispel fluids from the formation. As the role of nitrogen in this process diminishes, the role of carbon dioxide becomes more pronounced, and at the conclusion of the clean-up period, the gaseous carbon dioxide acts to expel fluids from the formation.

The amounts of nitrogen and carbon dioxide incorporated into the fracturing liquid at the wellhead depends upon the relative amounts of these gases desired at the bottom hole conditions and also the amount of the gaseous energizing phase (carbon dioxide and nitrogen) relative to the fracturing liquid phase. It often will be desirable to provide a system at reservoir conditions of about $\frac{2}{3}$ energizing phase and about $\frac{1}{3}$ liquid phase, roughly equivalent to a Mitchell foam quality, as defined in the aforementioned patent to Blauer et al., of about 65–70%. A desirable makeup of the energizing phase at reservoir reconditions is about 1 volume part nitrogen to 2 volume parts carbon dioxide. These ratios may, of course, change depending on reservoir conditions, the nature of the fracturing liquid and the like. For example, where scale formation is a serious problem, a somewhat larger amount of nitrogen may be desirable.

As will be recognized by those skilled in the art, the nitrogen and carbon dioxide will undergo volume changes between the surface conditions and the reservoir conditions and these should be taken into account in formulating the makeup of the fracturing fluid at wellhead conditions. Changes in the volume of nitrogen, which is in the gas phase at both the surface and subsurface conditions, will conform closely to the General Gas Law equation. Usually, the nitrogen volume will decrease somewhat from surface to downhole conditions, although as indicated hereinafter increases in n1trogen volume can occur, for example in the case of high temperature wells, and where there is a very high flowing pressure gradient down the well tubular goods. Changes in carbon dioxide volume from the surface to the reservoir conditions will occur due to expansion occasioned by the phase change and also because of changes in pressure and temperature, following the Gas Law equation. In general, the carbon dioxide volume will undergo volumetric expansion although in relatively high pressure, cool reservoirs there may be no expansion and even some contraction of carbon dioxide volume.

The volume ratio of nitrogen to carbon dioxide at wellhead conditions is within the range of about 0.2–1.0, preferably 0.2–0.8 and more, and preferably within the range of 0.3–0.6. The ratio of the energizing phase (nitrogen and carbon dioxide) to the fracturing liquid (including thickeners and other additives but not including the propping agent) is normally within the range of about 1–4. Where the ratio of the energizing phase to the fracturing liquid phase is near the upper end of the aforementioned range, it usually will be desirable to use greater amounts of nitrogen and reduced amounts of carbon dioxide, i.e. the nitrogen/carbon dioxide ratio will tend to increase as the ratio of the energizing phase to the liquid fracturing phase increases.

As explained previously, downhole conditions, especially pressure, are in a transient state in the course of the fracturing operation. For design purposes, the downhole temperature and pressure conditions may be determined based upon downhole pressure and temperature conditions as determined by well shut-in tests or other procedures which will provide a reliable basis upon which to estimate the pressure and temperature conditions immediately adjacent the well.

Using these designed criteria, it usually will be preferred to provide a ratio of energizing phase to liquid phase at the downhole conditions within the range of about 1.5–2.5. The relative volume amount of the energizing phase from the wellhead to the downhole conditions will usually decrease somewhat and accordingly it will be preferred to provide at the wellhead conditions a volume ratio of carbon dioxide and nitrogen to water within the range of about 1.5–3.0. The more preferred volume ratio of nitrogen to carbon dioxide at the wellhead conditions is within the range of about 0.3–0.6. It will usually be desirable to observe the constraints described previously with respect to the energizing phase/water ratio and the nitrogen/$CO_2$ ratio. That is, where the energizing phase/fluid ratio is near the upper range of 3.0 the nitrogen/$CO_2$ ratio should be near the upper limit of its respective range, e.g., about 0.5–0.6.

Polymers useful in the formation of the stable fracturing fluid of the present invention are gelling agents which are hydratable and cross-linkable polymers which contain one or more of the following functional groups: hydroxyl, cis-hydroxyl, carboxyl, sulfate, sulfonate, amino or amide. Polysaccharides and polysaccharide derivatives, which contain one or more of the monosaccharides such as glucose, galactose, mannose, xylose, arabinose, fructose are also useful. Examples of polysaccharide derivatives which are suitable in the practice of the present invention include: guar, derivatized guar such as HPG (hydroxypropyl guar), HEG hydroxy ethyl guar and CMHPG (carboxymethyl hydroxypropyl guar), cellulose and its derivatives such as CMHEC (carboxymethyl hydroxyethylcellulose) xanthan and starch.

In addition, the hydratable cross-linkable gelling agents can be synthetic polymers, copolymers and terpolymers. Examples of these synthetic polymers include, but are not limited to, polyacrylate, polymethylacrylate, polyacrylamide, acrylamide methyl propane sulfonic acid copolymers, polyvinyl alcohol, polyvinylpyrrol, and maleic and anhydride methylvinyl ether copolymers.

Cross-linking agents which can be combined with the solution of polymeric thickening agents include multivalent metal ions such as titanium, zirconium, chromium, antimony, iron and aluminum. The cross-linking agents and polymers can be combined in any suitable fashion. Such combinations include, but are not limited to: admixing guar and its derivatives as a polymer with a cross-linking agent of titanium or zirconium; a polymer composition of cellulose and its derivatives cross-linked with titanium or zirconium; acrylamide methyl propane sulfonic acid copolymer cross-linked with zirconium. Compounds suitable for use as cross-linking agents are well known to those skilled in the art and the examples include titanium triethanolamine, zirconium oxychloride, aluminum sulfate, chrominium chloride, zirconium carbonate and titanium acetylacetonate. By way of example, titanium triethanolamine is a particularly effective cross-linking agent with HPG, titanium acetylacetonate is an effective agent for HPG or CMHEC. In general, the metal ion cross-linking agents are used in an amount to provide about 10 ppm to 200 ppm of multivalent metal ion in the aqueous fluid. For example, aluminum sulfate $(A_2SO_4)_3$ is added to the fracturing fluid in an amount of 160 ppm would provide an aluminum ion concentration of 25 ppm. In the practice of the present invention, a cross-linking agent catalyst is not required but can be utilized if desired.

The amount of polymer utilized depends upon the desired viscosity of the aqueous phase. Preferably, sufficient polymer should be utilized to produce a viscosity of the aqueous fluid from about 10 centipoise to 100 centipoise before cross-linking. In general, this will result in concentrations in the range of about 15 pounds of polymer per 1000 gallons of aqueous solution or acid to about 80 pounds of polymer per 1000 gallons of aqueous solution or acid. As noted previously, viscosities up to about 300 centipoises may sometimes be desirable and in such cases correspondingly greater amounts of polymer may be added.

In carrying out the invention, there is provided a finely divided mixture of the liquid carbon dioxide in the aqueous phase such that small droplets of carbon dioxide are dispersed throughout the aqueous phase. This finely divided mixture, together with subsequent cross-linking to provide viscosity enhancement which results in the encapsulation of dispersed liquid carbon dioxide droplets prior to injection into the formation. Thus, cross-linking is delayed until small droplets of carbon dioxide are mixed throughout the aqueous phase by turbulent mixing. This turbulent mixing may be the result of pumping the fluid down the well or because of surface equipment, e.g., a mixing T and/or turbulence inducing veins such as used in static mixers.

Additionally, the aqueous phase may contain other additives routinely used in industry practice. For example, besides polymers, cross-linking agents and catalysts, the aqueous phase may contain the following additional components: biocides, surface tension reducing nonemulsifying surfactants, clay control agents, salts, fluid loss additives, buffers, gel breakers, iron control agents, paraffin inhibitors, and, as discussed previously, alcohols.

In practicing the present invention, the polymer and other additives, but not the cross-linking agent, may be blended into water. Once the additives are thoroughly blended with the water and the water initially "gelled" (the polymer hydrated), the thickened aqueous phase is transferred from the storage tanks to a blender. Proppant, as required, is added to a mixing tub on the blender at a rate to provide the desired concentration. The gel or gel/proppant slurry is transferred by means of a transfer pump at a low pressure, generally about 100 psi, to high pressure, generally greater than 500 psi, tri-plex pumps. The flow rate of transfer is such to provide a continuous supply of liquid or slurry to the tri-plex pumps. Should the transfer rate be greater than the supply rate required by the tri-plex pumps, the excess is returned to the blender tub. The tri-plex pumps inject the liquid or slurry into the treating (fracturing) line, which is connected directly to the wellhead at a desired rate and at a pressure required to hydraulically fracture the formation.

The cross-linking agent may be blended into the gelled fluid at a point between the tri-plex pump output that is connected in the treating line closest to the wellhead and the wellhead itself. The cross-linking agent may also be added prior to a mixing T, static mixer, or just prior to the entry of the well string. It is desirable that the cross-linking agent not be added too soon, otherwise it will begin cross-linking which will increase the viscosity and pumping requirements. The cross-linking agent should be added at a point where it will be mixed thoroughly in the fracturing fluid with most of the cross-linking accomplished in the well string. Actual injection is achieved using the high pressure injection pump at a rate such as to attain a stable mixture, after the addition of the energizing phase, liquid carbon dioxide, at reservoir conditions.

As will be recognized, the rate of reaction of the cross-linking agents varies from agent to agent depending primarily upon the polymer to be cross-linked, temperature and ph. The reaction rate of the cross-linking chosen must be rapid enough to cause effective cross-linking prior to entry into the formation.

The energizing phase, liquid carbon dioxide or carbon dioxide and nitrogen is introduced into the treating line downstream of the tri-plex pumps. While well treating pressure is maintained generally in the range of 1000 to 20,000 psi, the liquid carbon dioxide will expand slightly in volume from its volume on the surface due to the higher formation temperature, usually in excess of the critical temperature of carbon dioxide. At formation temperatures and treating pressures, the viscosity and density values of the carbon dioxide will be similar to those of the liquid carbon dioxide pumped. When treating pressure is released, the carbon dioxide will expand, assisting in well clean up.

The drawing is a schematic illustration of surface equipment which may be used in implementing the process of the present invention. As shown, a storage or holding facility such as tank 10 contains a thickened aqueous liquid having a viscosity within the range of 10–300 centipoises and preferably 10–100 centipoises, as noted previously. Generally, the viscous fluid is prepared on site by any suitable technique. For example, water tank 10 may take the form of a holding tank. Water from any suitable source, e.g., one or more large storage tanks or reservoirs may be treated by the addition of polymers and other additives to be incorporated into the fracturing fluid and then passed to the tank 10 where it is held for a sufficient period of time, for example, 1–10 minutes to permit the polymeric thickening agent to undergo hydration. The gel solution is pumped from tank 10 to a blender 12 wherein proppant is mixed from a proppant hopper 14. The resulting slurry of proppant and aqueous gel solution is pumped to a treating line 16 which includes one or more high pressure pumps 15, for example, triplex plex pumps, as described previously, which increase the pressure of the fracturing liquid to the wellhead injection pressure. As a practical matter, the addition of polymeric thickening agents, and other additives incorporated therewith, hydration of the aqueous fluid to form the initial gel, and the addition of propping agent is carried out under ambient temperature and pressure conditions. The pressure of the fracturing fluid is then boosted to a pressure of about 100–200 psig for supply to the input of the high pressure pumps 15. Liquid $CO_2$ which is under a pressure of several hundred psi is supplied from a storage vessel 18 to the high pressure treating line 16 by a booster pump 20. The resulting $CO_2$ and aqueous phase are then combined with nitrogen gas from a nitrogen storage tank 22 supplied by booster pump 23, and a cross-linking agent is then injected into the fracturing fluid, from a storage vessel 25 via pump 26.

The schematic diagram is for illustrative purposes only. The order of addition of $CO_2$ and nitrogen is not critical and may be reversed. As a practical matter, the relative order of addition of propping agent depicted in the drawing must be observed in order to allow the propping agent to be introduced at substantially atmospheric pressure. Since the fracturing fluid should be gelled prior to the inclusion of a propping agent, the initial mixing and hydration likewise takes place at atmospheric pressure. The cross-linking agent may be the last component added as shown. However, the cross-linking agent may be added immediately before the high pressure pumps 15 in order to avoid the need for a high pressure booster pump. Earlier addition of the cross-linking agent should be avoided as it may result in initiation of the cross-linking reaction and a premature increase in viscosity of the fracturing fluid, thereby unnecessarily increasing pumping requirements, as well as inhibiting good mixing or dispersion of the carbon dioxide and nitrogen in the gelled aqueous fluid. If desired, static mixers and turbulence inducing veins can be interposed in the process treatment line 16. However, generally the pumping of the fracturing fluid into the well tubular system, the tubing string or tubing casing annulus or both, will be sufficient to form a stabilized system.

Typically, $CO_2$ is supplied as a liquid at about $-10°$ F. to 10° F. at a pressure of about 250 to 350 psig. Nitrogen is supplied as a gas, normally at ambient temperature of from about 65° to 115° F. The composite fracturing fluid normally is at a pressure at the wellhead within the range of from about 1,000 to 20,000 psig.

Having described specific embodiments of the present invention, it will be understood that modification thereof may be suggested to those skilled in the art, and it is intended to cover all such modifications as fall within the scope of the appended claims.

We claim:

1. In a method for the hydraulic fracturing of a subterranean formation penetrated by a well, the steps comprising:

(a) providing an aqueous fracturing fluid having a viscosity at wellhead conditions within the range of 10–300 centipoises at a shear rate of 170 $sec^{-1}$;

(b) incorporating a normally gaseous energizing phase into said fracturing fluid;

(c) injecting said fracturing fluid containing said energizing phase into said well at the wellhead thereof and displacing said fracturing fluid down said well to the vicinity of said subterranean formation;

(d) during the displacement of said fracturing fluid from said wellhead to the vicinity of said subterranean formation increasing the viscosity of said fracturing fluid by a factor of about 2 or more; and (e) displacing said increased viscosity fracturing fluid from said well into said formation in the course of the fracturing process.

2. The method of claim 1, wherein the aqueous based fracturing fluid of step (a) contains a cross-linkable polymeric thickening agent which undergoes viscosity enhancement upon cross-linking and further comprising the step of incorporating a cross-linking agent into said fluid prior to the injection of said fracturing fluid into said well and deferring the cross-linking of said thickening agent so that the predominant viscosity enhancement caused by cross-linking of said thickening agent occurs after the distribution of said normally gaseous energizing phase into said fracturing fluid.

3. The method of claim 2, wherein said viscosity enhancement occurs predominantly in the course of the displacement of said fracturing fluid from said wellhead down to the vicinity of said formation.

4. The method of claim 2, wherein said normally gaseous energizing phase comprises carbon dioxide.

5. The method of claim 4, wherein said carbon dioxide is incorporated into said fracturing fluid in the liquid phase.

6. The method of claim 2, wherein said normally gaseous energizing phase comprises nitrogen.

7. The method of claim 2, wherein said normally gaseous energizing phase comprises carbon dioxide and nitrogen.

8. The method of claim 7, wherein said carbon dioxide and nitrogen are incorporated separately into said fracturing fluid.

9. The method of claim 8, wherein said carbon dioxide is incorporated into said fracturing fluid in the liquid phase.

10. In a process for the hydraulic fracturing of a subterranean formation penetrated by a well, the steps comprising:

(a) providing adjacent the wellhead of said well an aqueous fracturing fluid containing a cross-linkable polymeric thickening agent which has undergone hydration to effect an increase in viscosity of said fracturing fluid;

(b) subsequent to step (a) incorporating a cross-linking agent into said fracturing fluid;

(c) subsequent to step (a) incorporating a normally gaseous energizing phase comprising liquid carbon dioxide into said fracturing fluid;

(d) thereafter passing said fracturing fluid containing said cross-linking agent and said energizing phase to the wellhead and into said well under conditions to effect shearing of said fracturing fluid to produce turbulent mixing of said cross-linking agent within said fracturing fluid and causing viscosity enhancement of said fracturing fluid by cross-linking of said thickening agent and displacing said fracturing fluid down said well to the vicinity of said subterranean formation; and (e) thereafter displacing said hydraulic fluid from said well into said formation in the course of the fracturing process.

11. The process of claim 10, in which a substantial portion of the cross-linking of said thickening agent by said cross-linking agent is deferred until after the injection of said fracturing fluid into said well wherein substantial viscosity enhancement of said fracturing fluid due to the action of said cross-linking agent occurs subsequent to the introduction of said fracturing fluid into said well at the wellhead and during the flow of said fracturing fluid from said wellhead to the vicinity of s id subterranean formation.

12. In a method for the hydraulic fracturing of a subterranean formation penetrated by a well, the steps comprising:

(a) providing adjacent the wellhead of said well an aqueous fracturing fluid containing a cross-linkable polymeric thickening agent in a hydrated state providing a viscosity of said fracturing fluid within the range of 10–300 centipoises at a shear rate of 170 $sec^{-1}$;

(b) subsequent to step (a) incorporating a cross-linking agent into said aqueous fracturing fluid;

(c) subsequent to step (a) incorporating liquid carbon dioxide into said fracturing fluid;

(d) shearing said fracturing fluid to produce turbulent mixing to disperse carbon dioxide within said fracturing fluid and said cross-linking agent to cause viscosity enhancement of said fracturing fluid by cross-linking of said thickening agent;

(e) injecting said fracturing fluid into said well and displacing said fracturing fluid down said well to the vicinity of said subterranean formation; and (f) thereafter displacing said fracturing fluid from said well into said formation in the course of the fracturing process.

13. The method of claim 12, wherein the viscosity of said fracturing fluid in step (a) is within the range of 10–10 centipoises.

14. The method of claim 12, wherein a propping agent is incorporated into said fracturing fluid.

15. The method of claim 14, wherein said propping agent is incorporated into said fracturing fluid prior to the addition of said liquid carbon dioxide and said cross-linking agent.

16. The method of claim 12, wherein said cross-linking agent is incorporated into said fracturing fluid prior to the incorporation of said liquid carbon dioxide.

17. The method of claim 12, wherein nitrogen is incorporated into said fracturing fluid.

18. The method of claim 17, wherein the volume amount of nitrogen incorporated into said fracturing fluid is less than the volume amount of carbon dioxid at wellhead conditions.

19. In a method for the hydraulic fracturing of a subterranean formation penetrated by a well, the steps comprising:

(a) incorporating a thickening agent into an aqueous fluid to provide a viscous aqueous fracturing fluid;

(b) incorporating a propping agent into said viscous aqueous fracturing fluid;

(c) subsequent to step (b), incorporating liquid carbon dioxide into said aqueous fracturing fluid;

(d) subsequent to step (c) further increasing the viscosity of said fracturing fluid to an enhanced level sufficient to stabilize said liquid carbon dioxide in said fracturing fluid; and (e) injecting said fracturing fluid into said well under a pressure sufficient to implement said hydraulic fracturing of said formation.

20. The method of claim 19, wherein said thickening agent is a cross-linkable polymer and further comprising the step of incorporating a cross-linking agent into said fracturing fluid in order to increase the viscosity thereof to said enhanced level.

21. The method of claim 19, further comprising the step of subsequent to step (b) and prior to step (c) increasing the pressure on said fracturing fluid to the injection pressure specified in step (e).

22. The method of claim 21, wherein said thickening agent is a cross-linkable polymer and further comprising the step of incorporating a cross-linking agent into said fracturing fluid in order to increase the viscosity thereof to said enhanced level.

23. The method of claim 22, wherein t he predominant viscosity enhancement caused by the cross-linking of said thickening agent by said cross-linking agent occurs after the injection of said fracturing fluid into said well.

24. The method of claim 19, wherein sufficient carbon dioxide is incorporated into said aqueous fracturing fluid to provide a mixture in which liquid carbon dioxide is at least $\frac{1}{3}$ of the fracturing fluid injected into said well under wellhead conditions.

25. In a process for the hydraulic fracturing of a subterranean formation penetrated by a well, the steps comprising:

(a) providing adjacent the wellhead of said well an aqueous fracturing fluid containing a cross-linkable polymeric thickening agent which has undergone hydration to effect an increase in viscosity of said fracturing fluid, and said fluid does not contain a stabilizing surfactant;

(b) subsequent to step (a) incorporating a cross-linking agent into said fracturing fluid;

(c) subsequent to step (a) incorporating a normally gaseous energizing phase comprising liquid carbon dioxide into said fracturing fluid;

(d) thereafter passing said fracturing fluid containing said cross-linking agent in said energizing phase to the well head and into said well under conditions to effect shearing of said fluid to produce turbulent mixing of said cross-linking agent within said fracturing fluid and causing viscosity increase of said fracturing fluid by a factor of about 2 or more and displacing said fracturing fluid down said well to the vicinity of said subterranean formation; and (e) thereafter displacing said hydraulic fluid from said well into said formation in the course of the fracturing process.

26. The method of claim 25 in which the viscosity of said fracturing fluid in step (a) is within the range of 10–100 centipoises at a shear rate of 170 $SEC^{-1}$.

* * * * *

UNITED STATES PATENT AND TRADEMARK OFFICE

CERTIFICATE OF CORRECTION

PATENT NO. : 5,002,125

DATED : March 26, 1991

INVENTOR(S) : Phillips, et al.

It is certified that error appears in the above-identified patent and that said Letters Patent is hereby corrected as shown below:

Column 4, line 13, after "employed" insert --.--.

Column 5, line 63, delete "975" and insert therefor --'975--.

Column 6, line 45, after "Thickening" insert --agents--.

Column 6, line 52, delete "sec-" and insert therefor --$sec^{-1}$--.

Column 7, line 17, delete "wil" and insert therefor --will--.

Column 12, line 12, after "triplex" delete "plex".

Column 14, line 18, delete "s id" and insert therefor --said--.

Column 14, line 45, delete "10-10" and insert therefor --10-100--.

Column 14, line 60, delete "dioxid" and insert therefor --dioxide--.

UNITED STATES PATENT AND TRADEMARK OFFICE

CERTIFICATE OF CORRECTION

PATENT NO. : 5,002,125

DATED : March 26, 1991

INVENTOR(S) : Phillips, et al.

It is certified that error appears in the above-identified patent and that said Letters Patent is hereby corrected as shown below:

Column 15, line 25, delete "t he" and insert therefor --the--.

Signed and Sealed this

Eleventh Day of August, 1992

*Attest:*

DOUGLAS B. COMER

*Attesting Officer*

*Acting Commissioner of Patents and Trademarks*